US007311552B1

(12) United States Patent
Ko

(10) Patent No.: US 7,311,552 B1
(45) Date of Patent: Dec. 25, 2007

(54) MICRO COAXIAL CABLE CONNECTOR ASSEMBLY

(75) Inventor: David (Tso-Chin) Ko, Fullerton, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/481,232

(22) Filed: Jul. 3, 2006

(51) Int. Cl.
*H01R 9/05* (2006.01)

(52) U.S. Cl. ..... 439/579; 439/497; 439/404

(58) Field of Classification Search ..... 439/579, 439/394, 607, 942, 610, 108, 497, 404
See application file for complete search history.

(56) References Cited

U.S. PATENT DOCUMENTS 4,508,414 A * 4/1985 Kusui et al. ..... 439/610
5,766,033 A 6/1998 Davis
6,062,896 A 5/2000 Huang
6,123,582 A 9/2000 Ko et al.
6,305,978 B1 10/2001 Ko et al.
6,305,979 B1 * 10/2001 Ko ..... 439/579
6,338,652 B1 1/2002 Ko
6,544,050 B1 * 4/2003 Ko ..... 439/108
6,619,985 B1 9/2003 Ko
6,705,893 B1 3/2004 Ko
6,772,516 B2 8/2004 Lomastro et al.
6,832,931 B1 * 12/2004 Wu ..... 439/499
2004/0043658 A1 * 3/2004 Ko ..... 439/607
2006/0246776 A1 * 11/2006 Itou et al. ..... 439/579

* cited by examiner

*Primary Examiner*—Tho D. Ta
*Assistant Examiner*—Vanessa Girardi
(74) *Attorney, Agent, or Firm*—Wei Te Chung

(57) ABSTRACT

A micro coaxial cable connector assembly (100) including an insulated housing (1), a plurality of contacts (2) received in the insulated housing (1), a number of coaxial wires (4) soldered to the contacts (2), a wire spacer (3) used for positioning the coaxial wires (4) and a metal shell (5) assembled to the insulated housing (1) to reduce EMI. The connecting portions and rear portions of the contacts are placed in the slots (107) of the insulated housing (1) forming a plurality of soldering areas. The coaxial wires (4) are soldered to the contacts (2) with conductors held by the cutouts of the rear portions of the contacts (2) and placed in the soldering areas.

20 Claims, 15 Drawing Sheets

2

MICRO COAXIAL CABLE CONNECTOR ASSEMBLY

BACKGROUND OF THE INVENTION

1. Field of the Invention

The present invention generally relates to a cable connector assembly, and more particularly to a micro coaxial cable connector assembly having a relatively low profile and multi-pitch contacts.

2. Description of Related Art

A micro coaxial cable connector is widely used in the high frequency communication connector field and is required to terminate a coaxial multiconductor wires. Because of its wide use, designers have designed different structures to satisfy different applications. For example, U.S. Pat. No. 5,766,033 discloses a high density electrical connector. The electrical connector having a housing molded around body sections of a plurality of terminals disposed in first and second rows. The terminals have IDC termination sections for respective wires to be urged thereinto by termination covers. Those IDC termination sections of the first row are staggered rearwardly from those IDC termination sections of the second row to facilitate wire insertion. However, if conductors of wires are so slim that they are may be badly damaged when urged into the termination sections. U.S. Pat. No. 6,338,652 discloses another cable connector assembly. The cable connector assembly includes a cable connector and a coaxial multiconductor cable set. The cable set includes a grounding bar electrically connected to braidings of each coaxial wire. The cable connector comprises a housing, an insert with a number of terminals, a grounding plate, and a shield surrounding the insulated housing. The cable set is connected to the insert, the conductors soldered to the terminals and the grounding bar mating with the insert, The grounding plate has a pair of arms contacting the grouding bar engaged with the insert and the shield provides a pair of fingers pressing against the arms of the grouding plate, thereby establishing a grounding path between the shield, the grounding plate, the grounding bar and the braidings. However, the grounding means of this kind of cable connector assembly is relatively complex in structure and costly in manufacture cost. These two shortcomings are not glad to be seen by the manufactures and customers. Other grouding means, such as insulated displacement (IDC) is more simple and rapid, but the electrical connection may not be reliable because wires urged into IDC sections may be cut off or badly damaged if the wires are too slim.

Hence, a low profile micro coaxial cable connector assembly with improved structure making a wire electrically connecting to a contact reliable is highly desired to overcome the disadvantage of the related art. Also, the low profile micro coaxial cable connector assembly with improved structure making grouding means more simple is highly desired to overcome the disadvantage of the related art.

SUMMARY OF THE INVENTION

Accordingly, one object of the present invention is to provide a low profile micro coaxial cable connector assembly with improved structure making a wire connecting to a contact more reliable.

Another object of the present invention is to provide a low profile micro coaxial cable connector assembly with improved structure making grouding means more simple.

In order to achieve the object set forth, a micro coaxial cable connector assembly in accordance with the present invention comprises an insulated housing, a plurality of contacts, a number of wires and a metal shell. The insulated housing defines a base portion with a plurality of passages thereon and a matching portion extending outwardly from the base portion. A plurality of contacts each received in the insulated housing with mating portion positioned in the matching portion and connecting portion together with rear portion disposed in the corresponding passage to from a soldering area; and the rear portion of each contact defines a cutout. A mass of wires each with a conductor is held by corresponding cutout of the rear portion of the contact respectively. A metal shell with an end wall defines a plurality slots each adapted for receiving and electrically contacting with a braiding layer of the corresponding wires.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
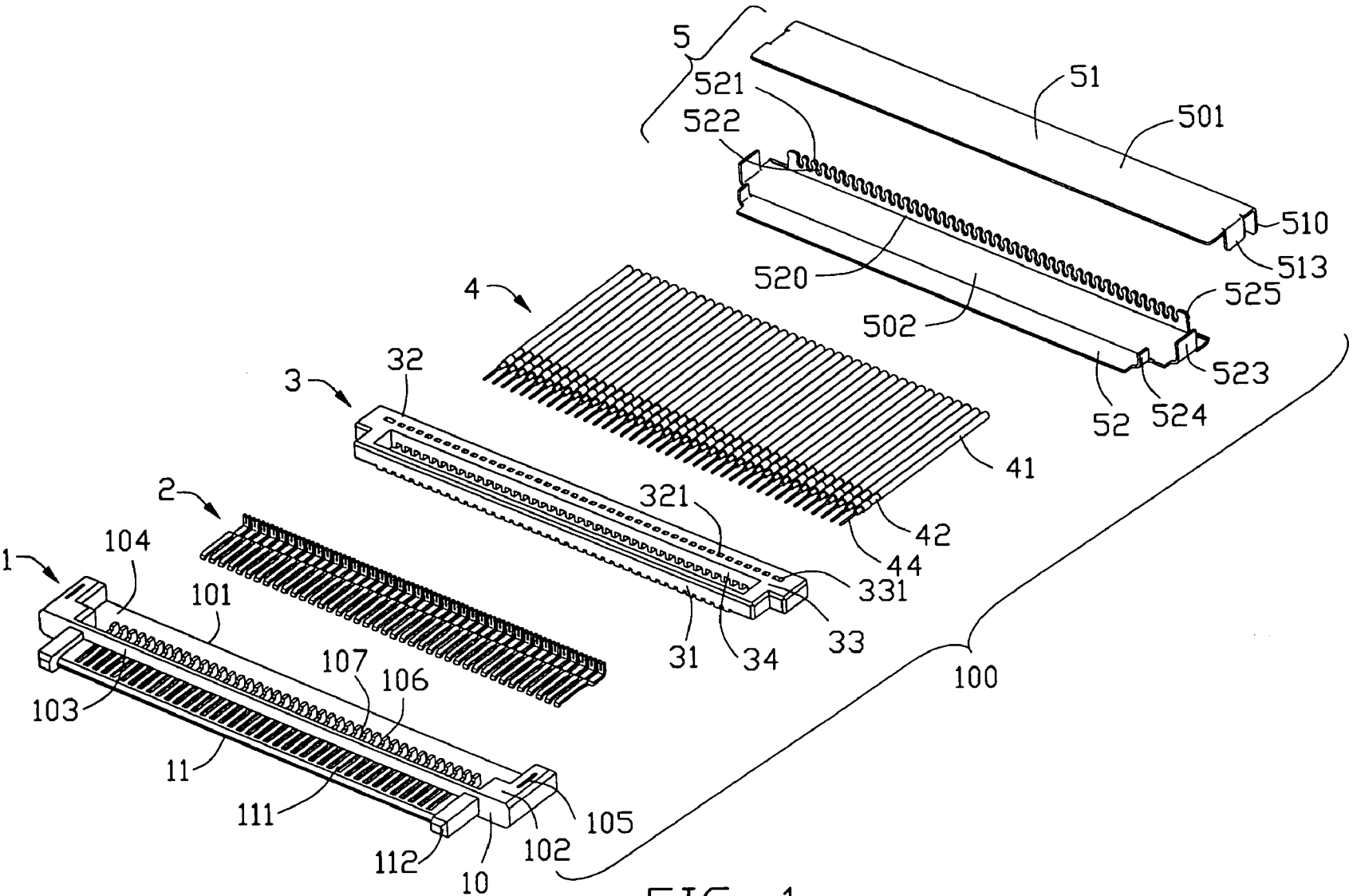
FIG. 1 is an exploded, perspective view of a micro coaxial cable connector assembly in accordance with the first embodiment of the present invention.
Figure 2:
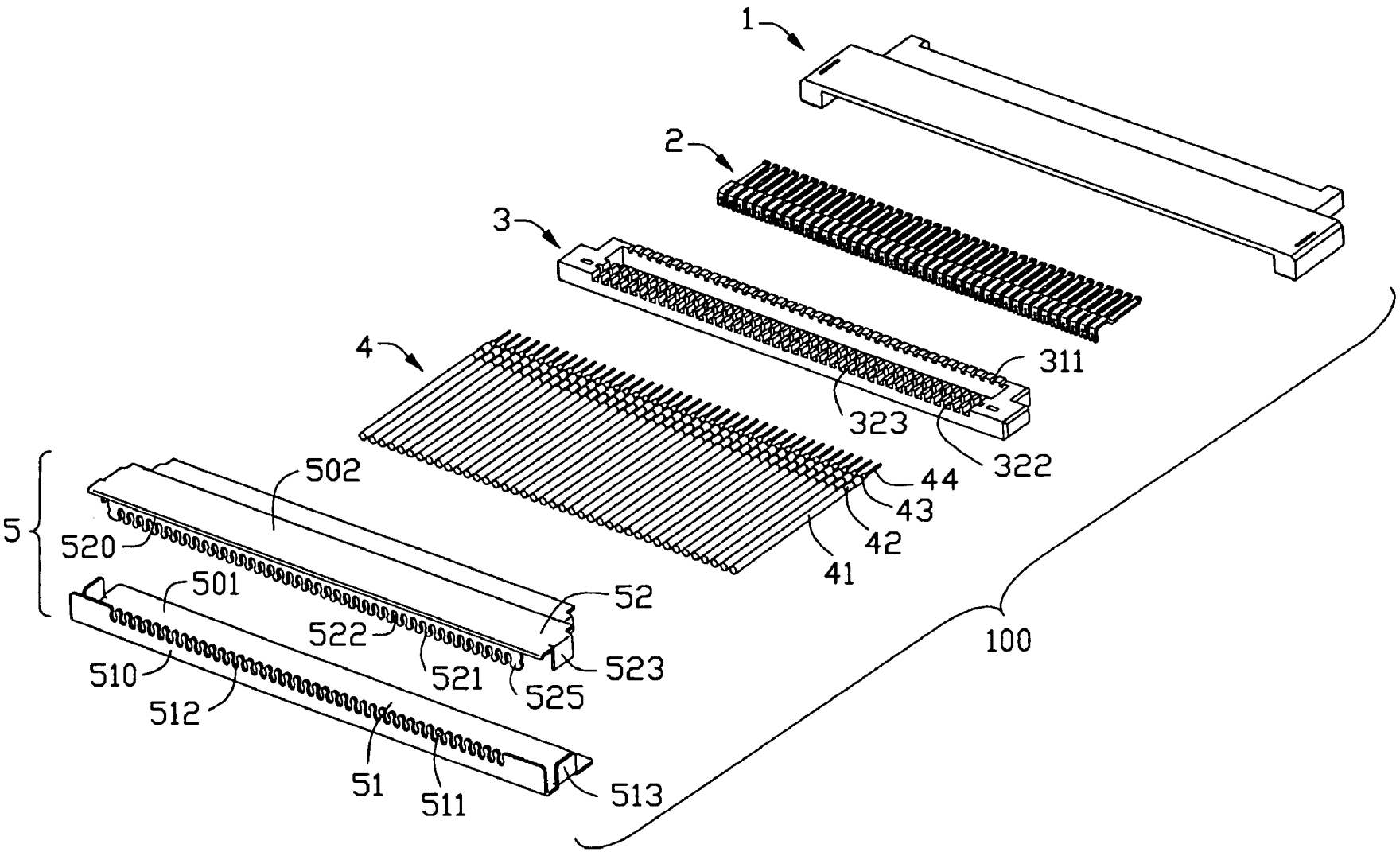
FIG. 2 is a view similar to FIG. 1, but viewed from another aspect.
Figure 3:
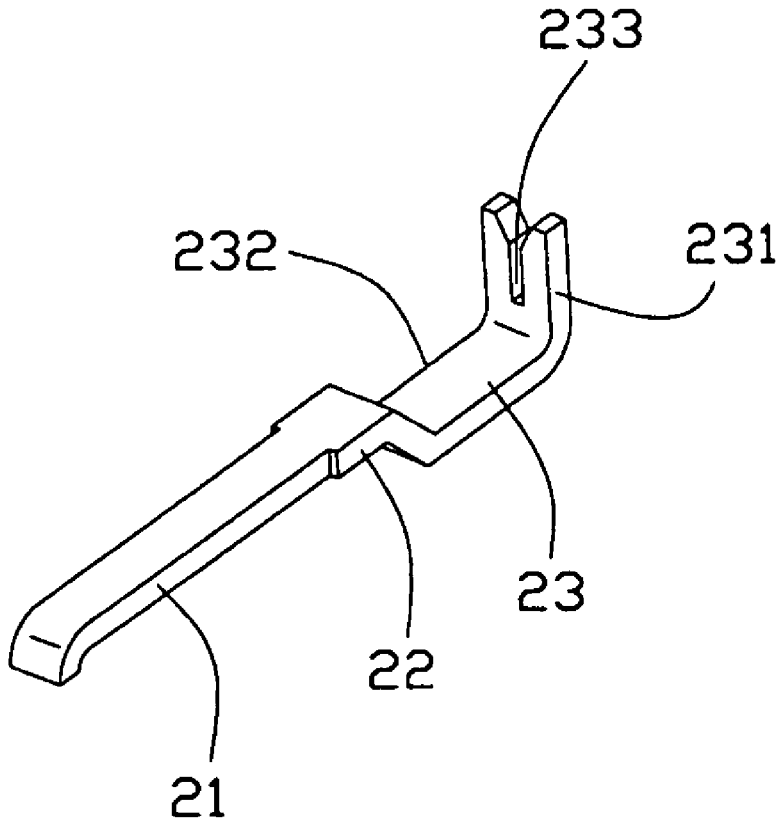
FIG. 3 is an enlarged view of a contact shown in FIG. 1.
Figure 4:
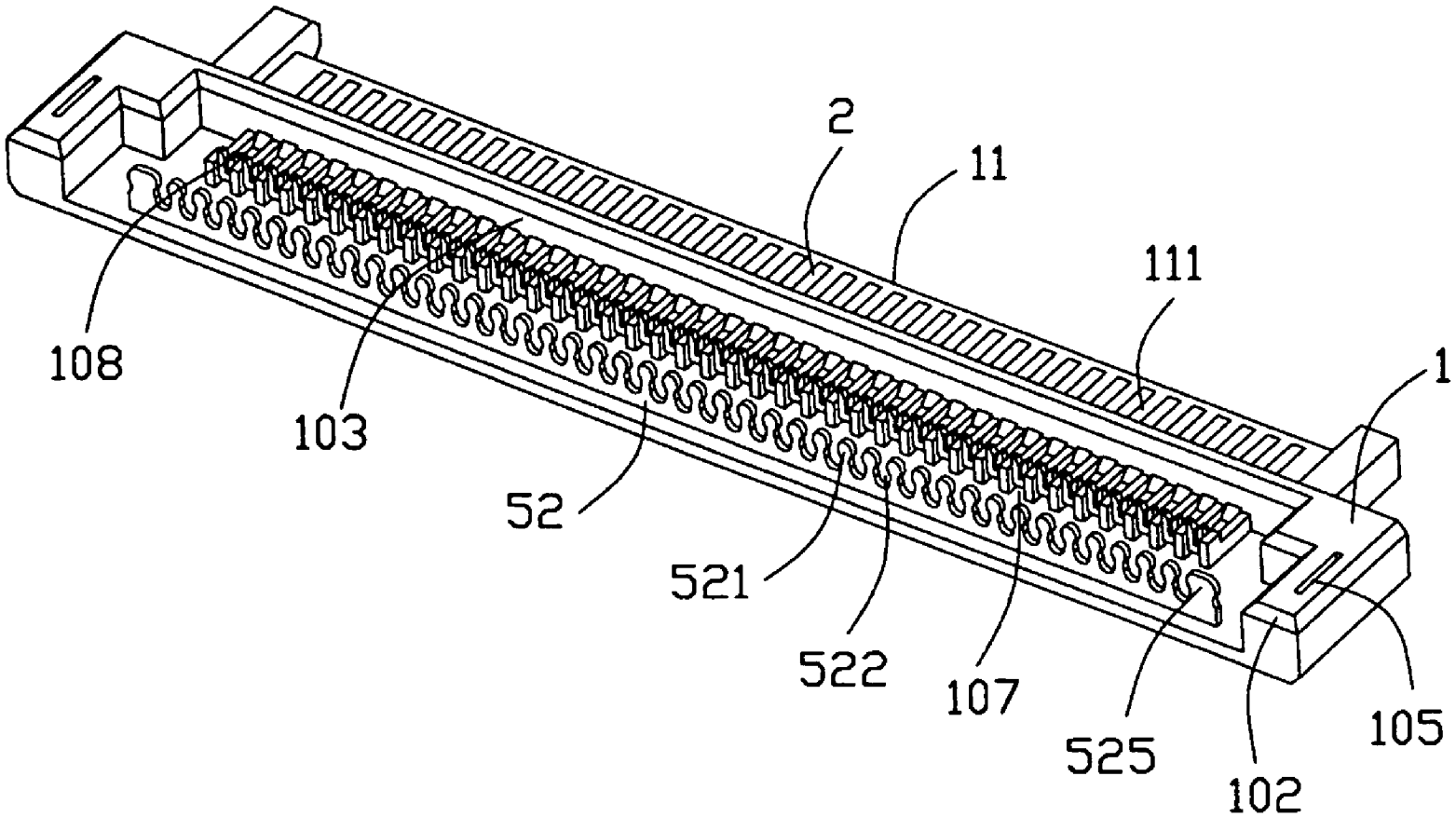
FIG. 4 is a partially assembled, perspective view of FIG. 1.
Figure 5:
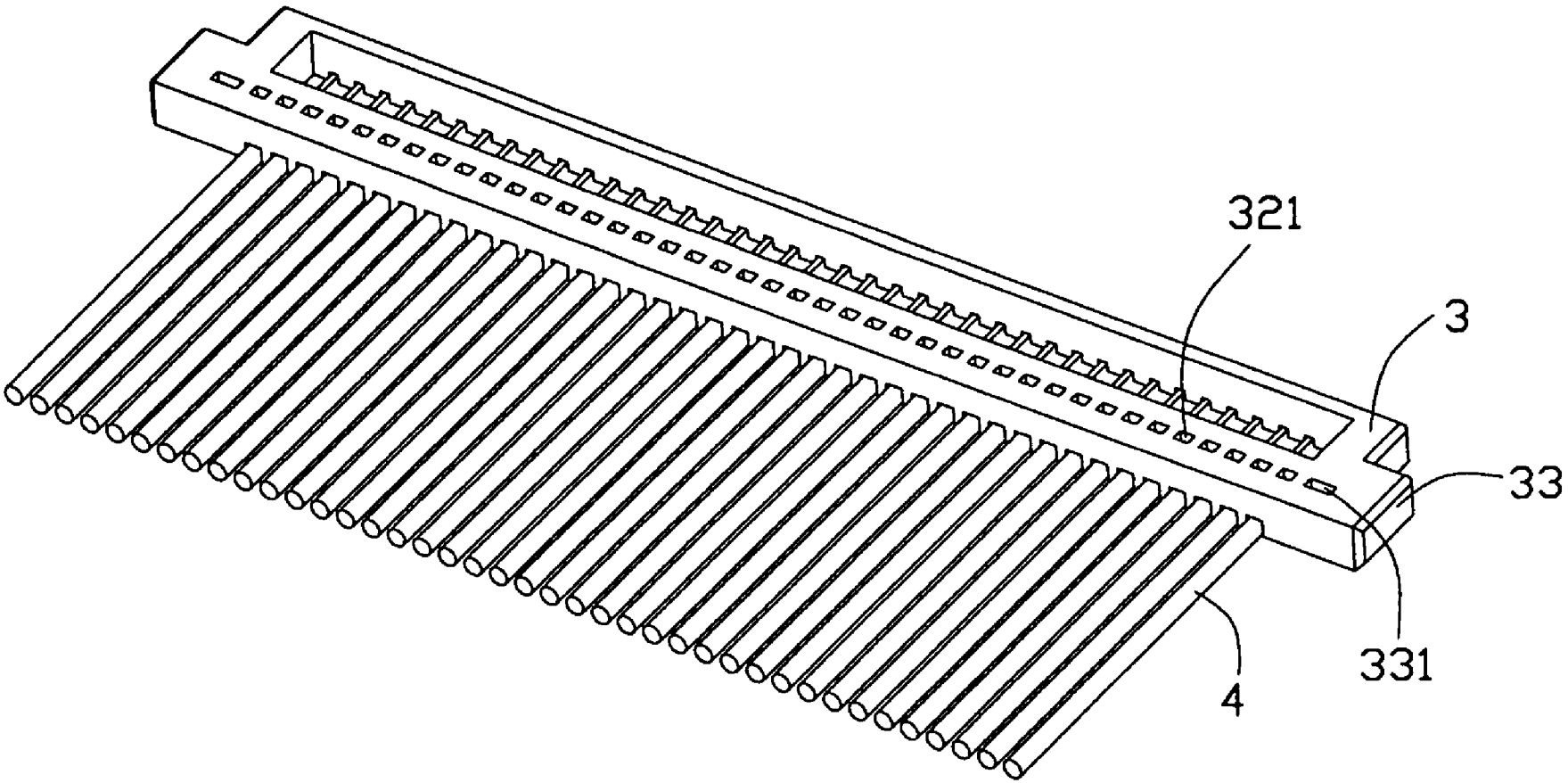
FIG. 5 is another partially assembled, perspective view of FIG. 1.
Figure 6:
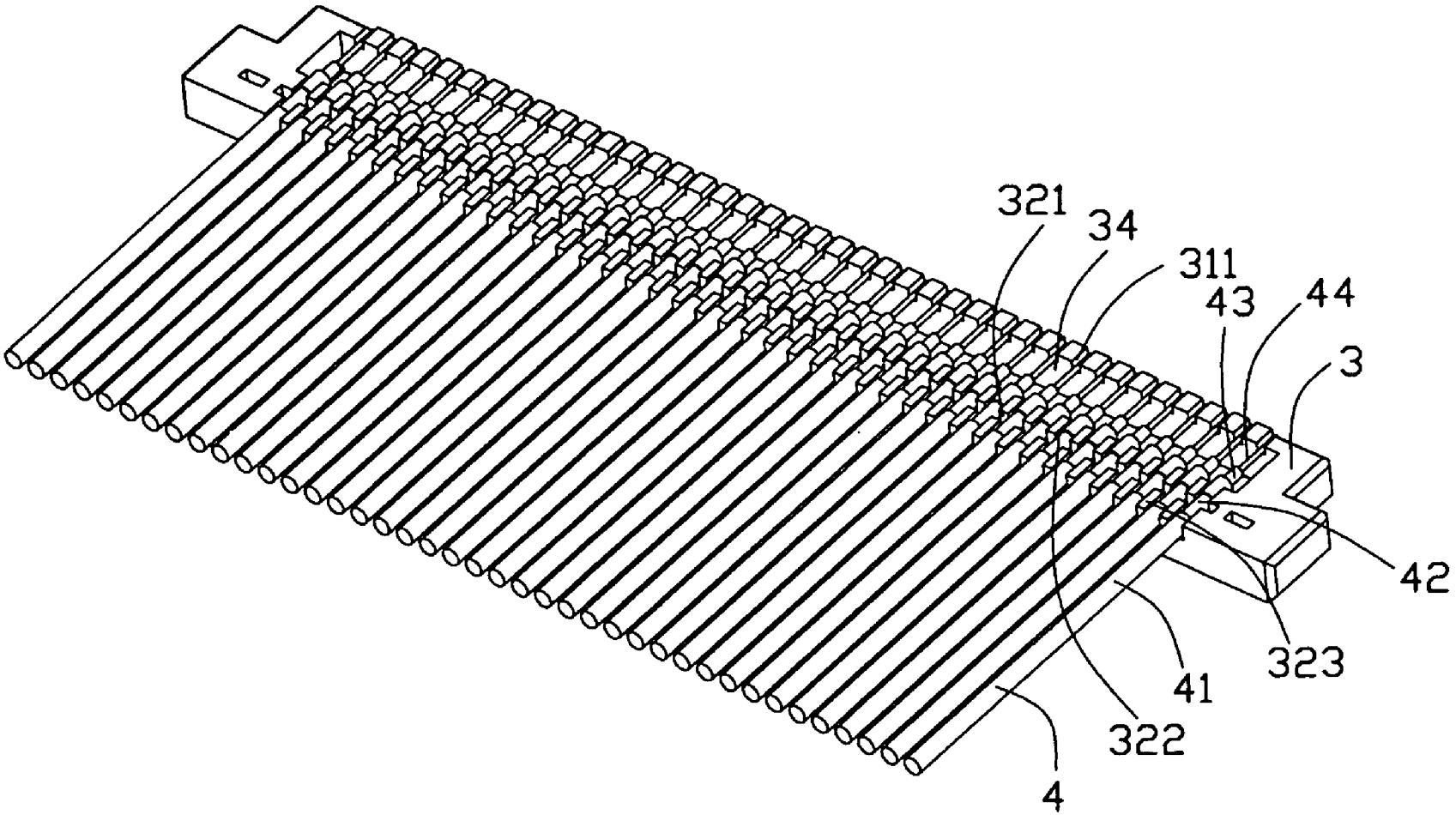
FIG. 6 is a view similar to FIG. 5, but viewed from a different aspect.
Figure 7:
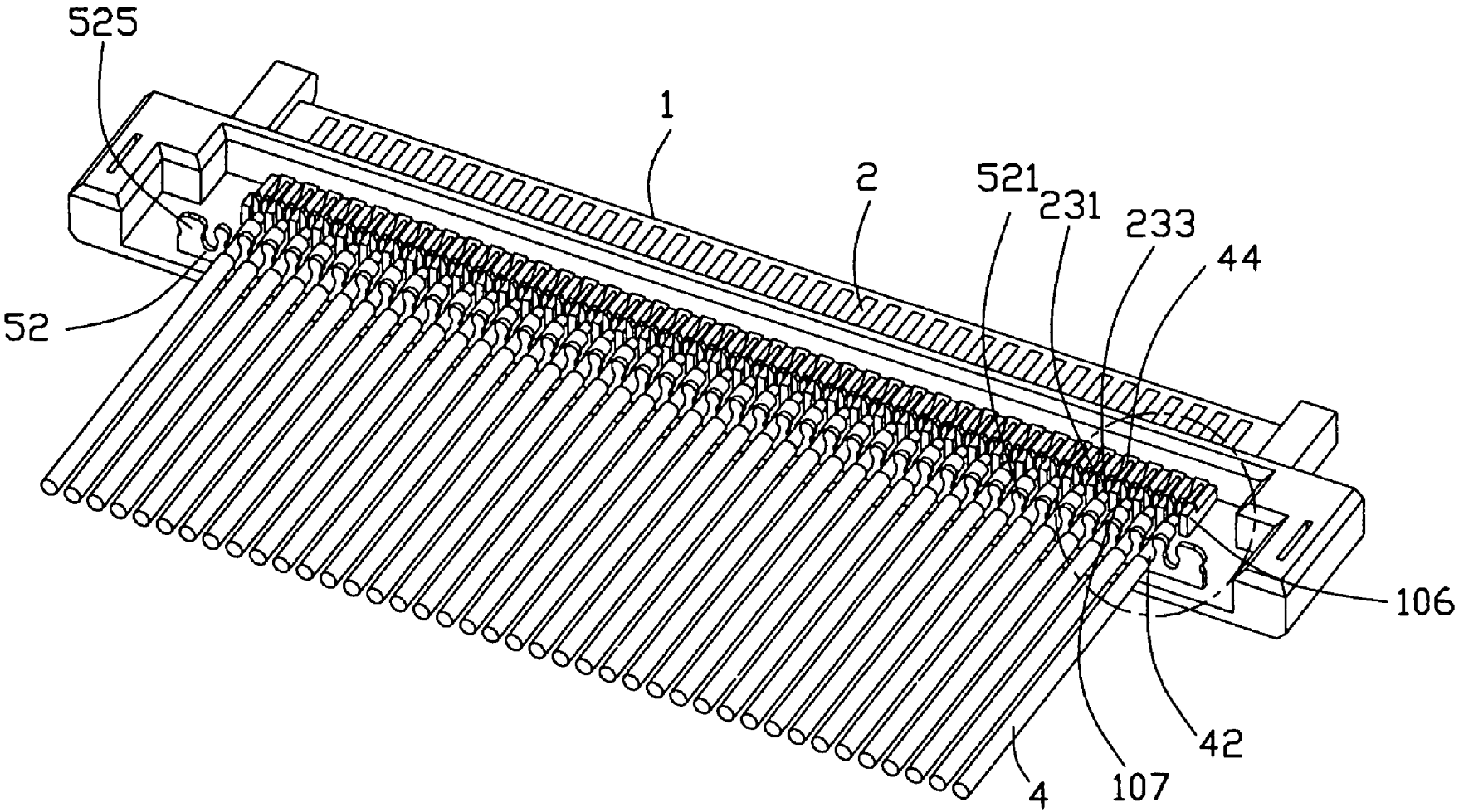
FIG. 7 is a third partially assembled, perspective view of FIG. 1.
Figure 8:
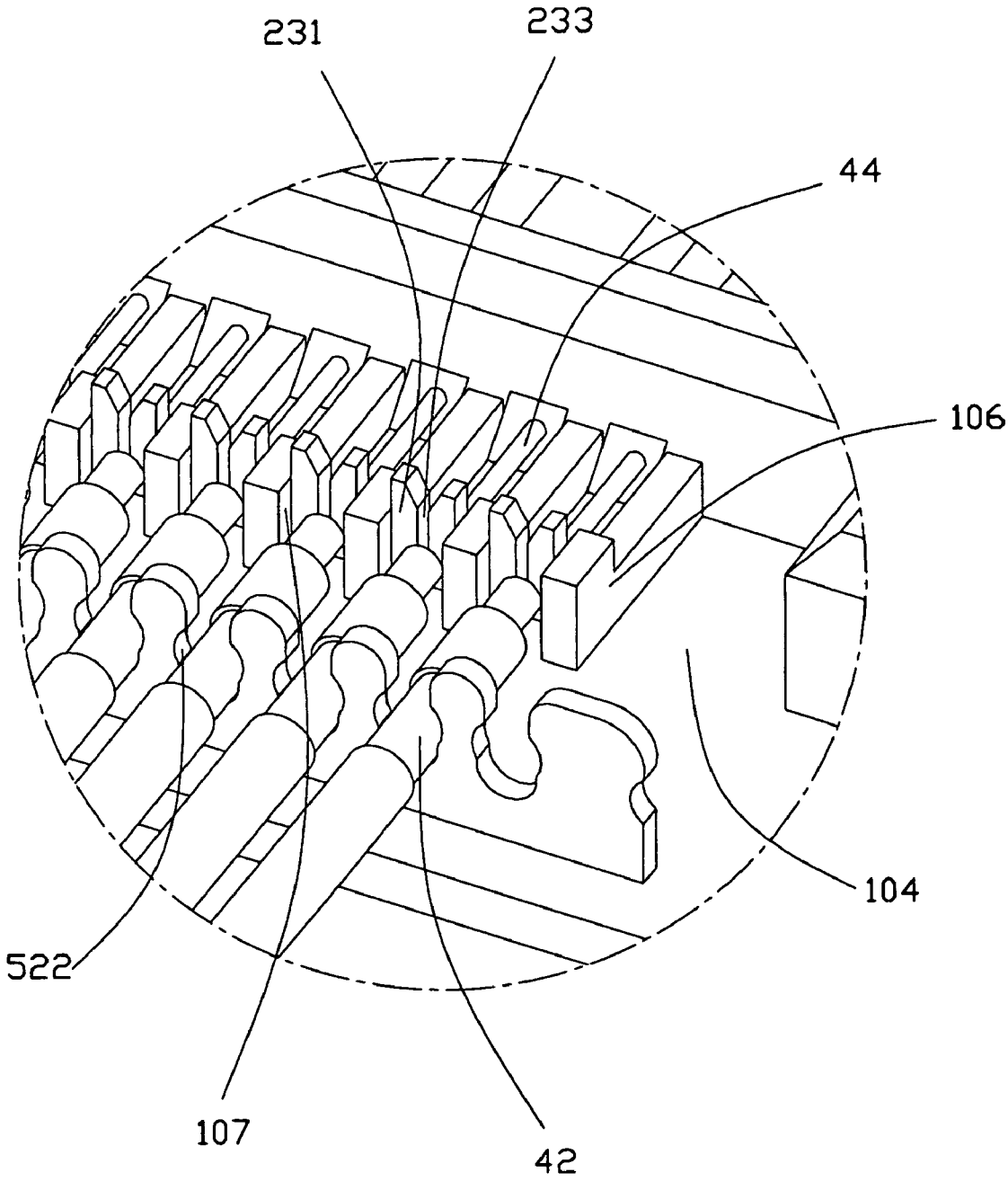
FIG. 8 is an enlarged view of an encircled portion of FIG. 7.
Figure 9:
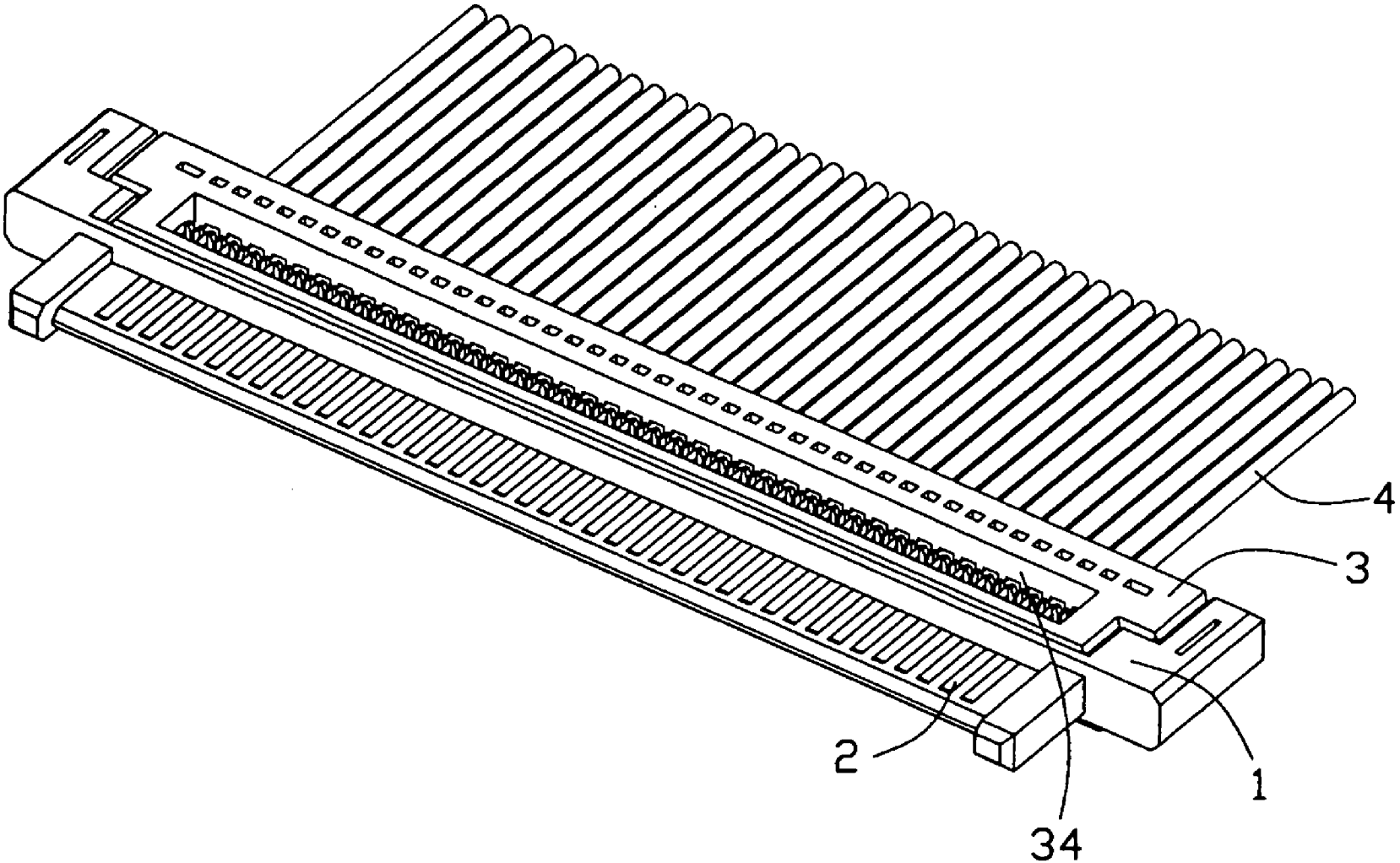
FIG. 9 is a fourth partially assembled, perspective view of FIG. 1.
Figure 10:
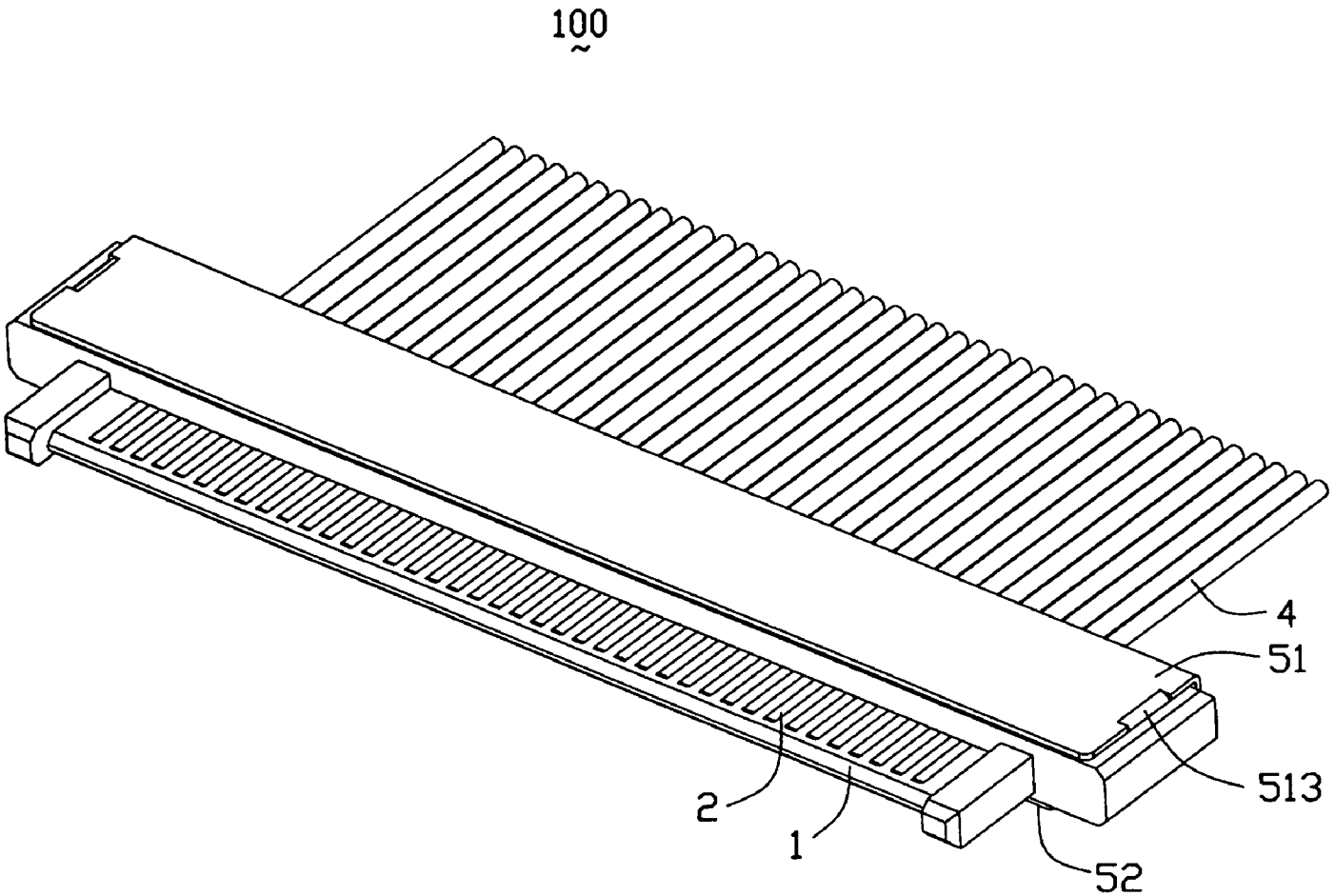
FIG. 10 is an assembled, perspective view of a micro coaxial cable connector assembly of the first embodiment.
Figure 11:
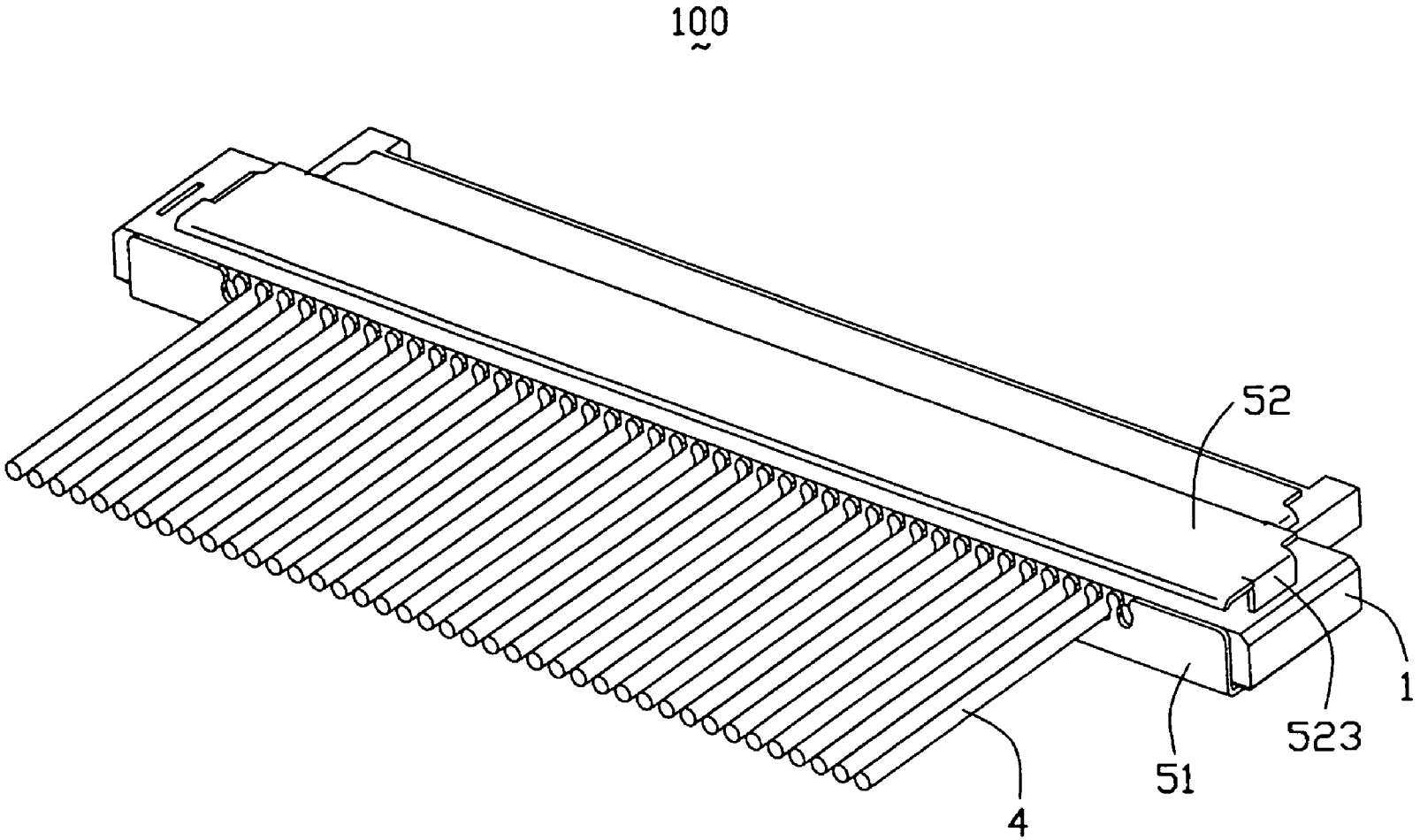
FIG. 11 is a view similar to FIG. 10, but viewed from another aspect.
Figure 12:
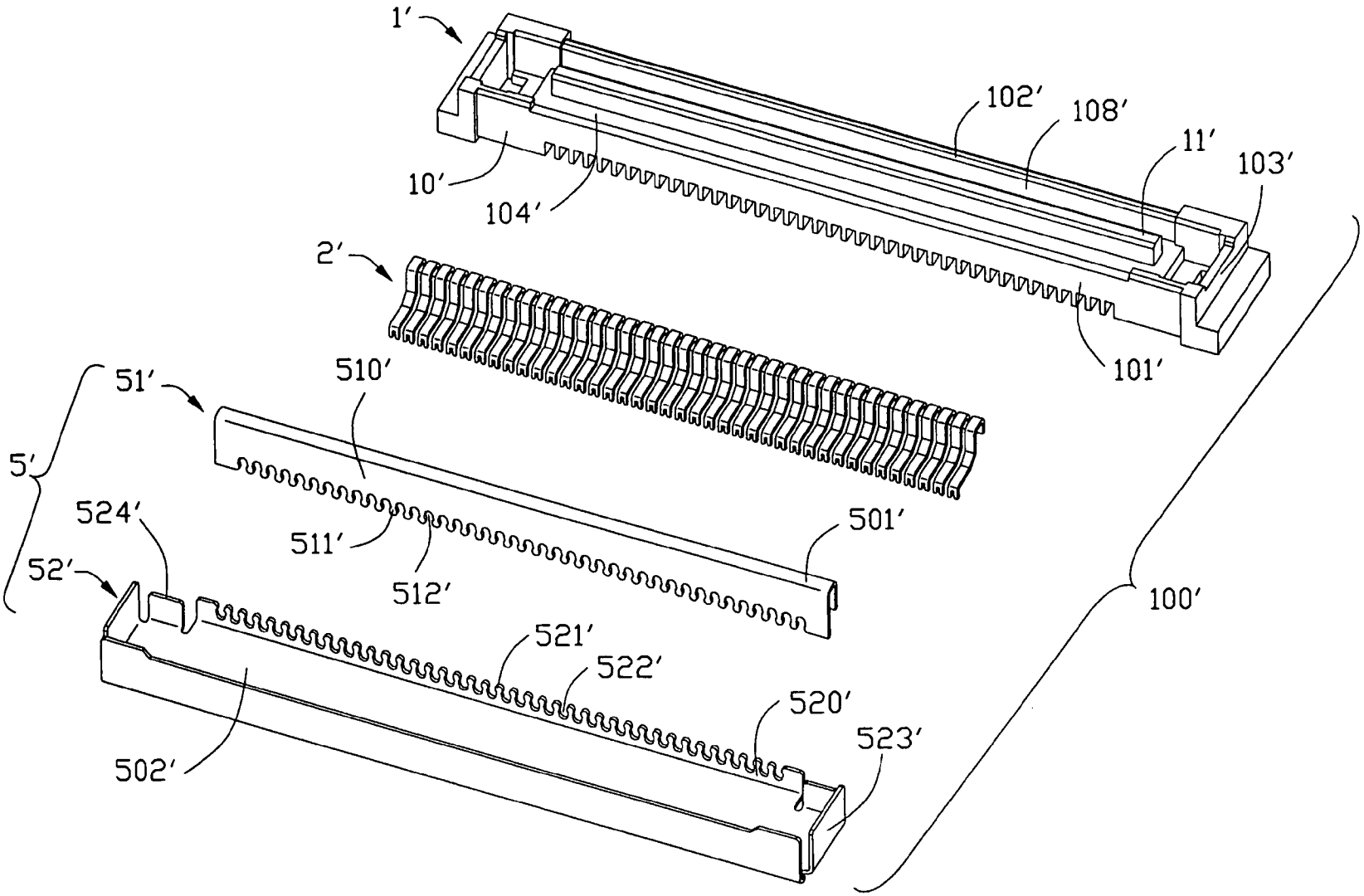
FIG. 12 is a partially exploded, perspective view of a micro coaxial cable connector assembly in accordance with the second embodiment of the present invention with wires omitted.
Figure 13:
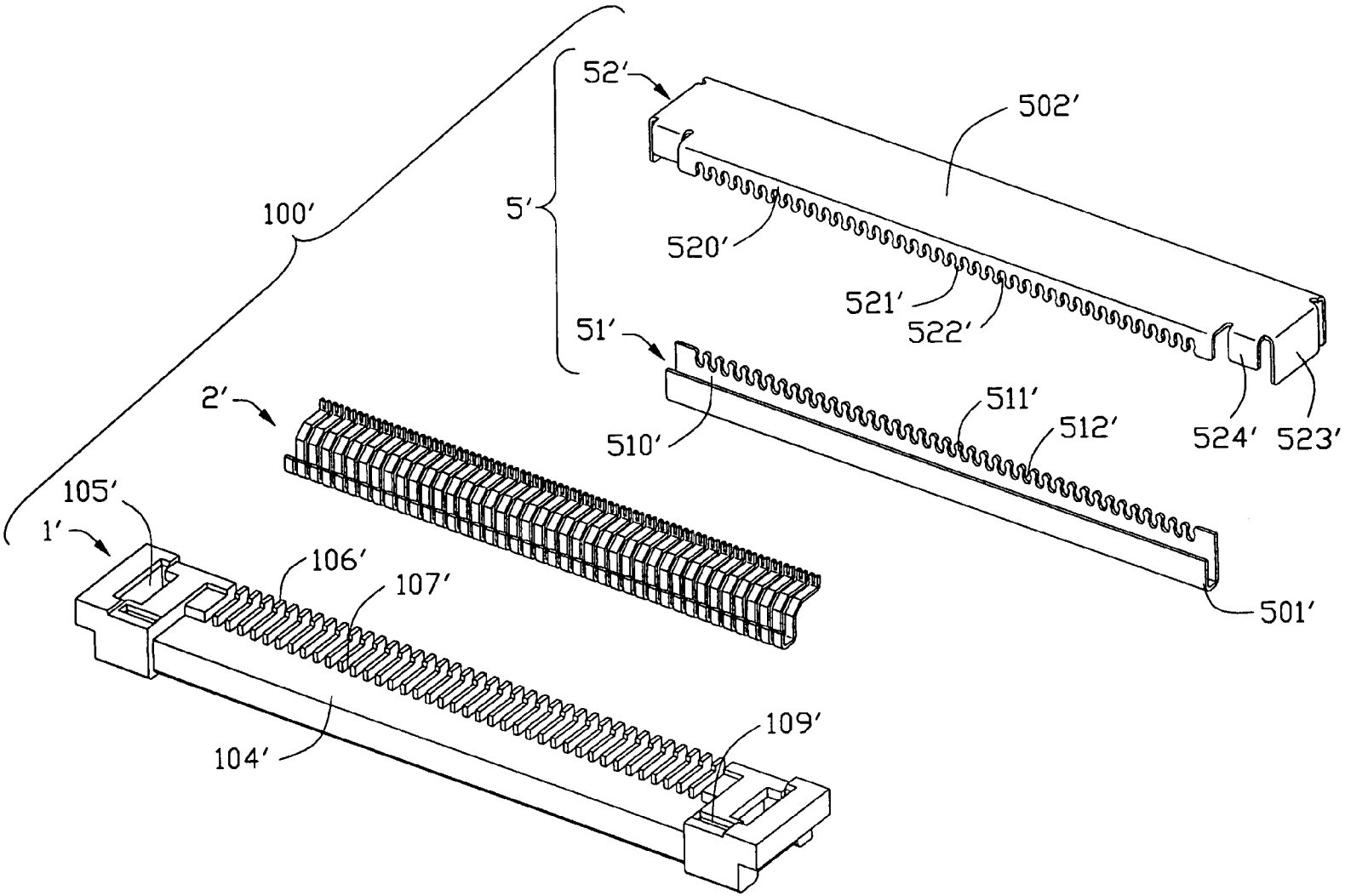
FIG. 13 is a view similar to FIG. 12, but viewed from another aspect.
Figure 14:
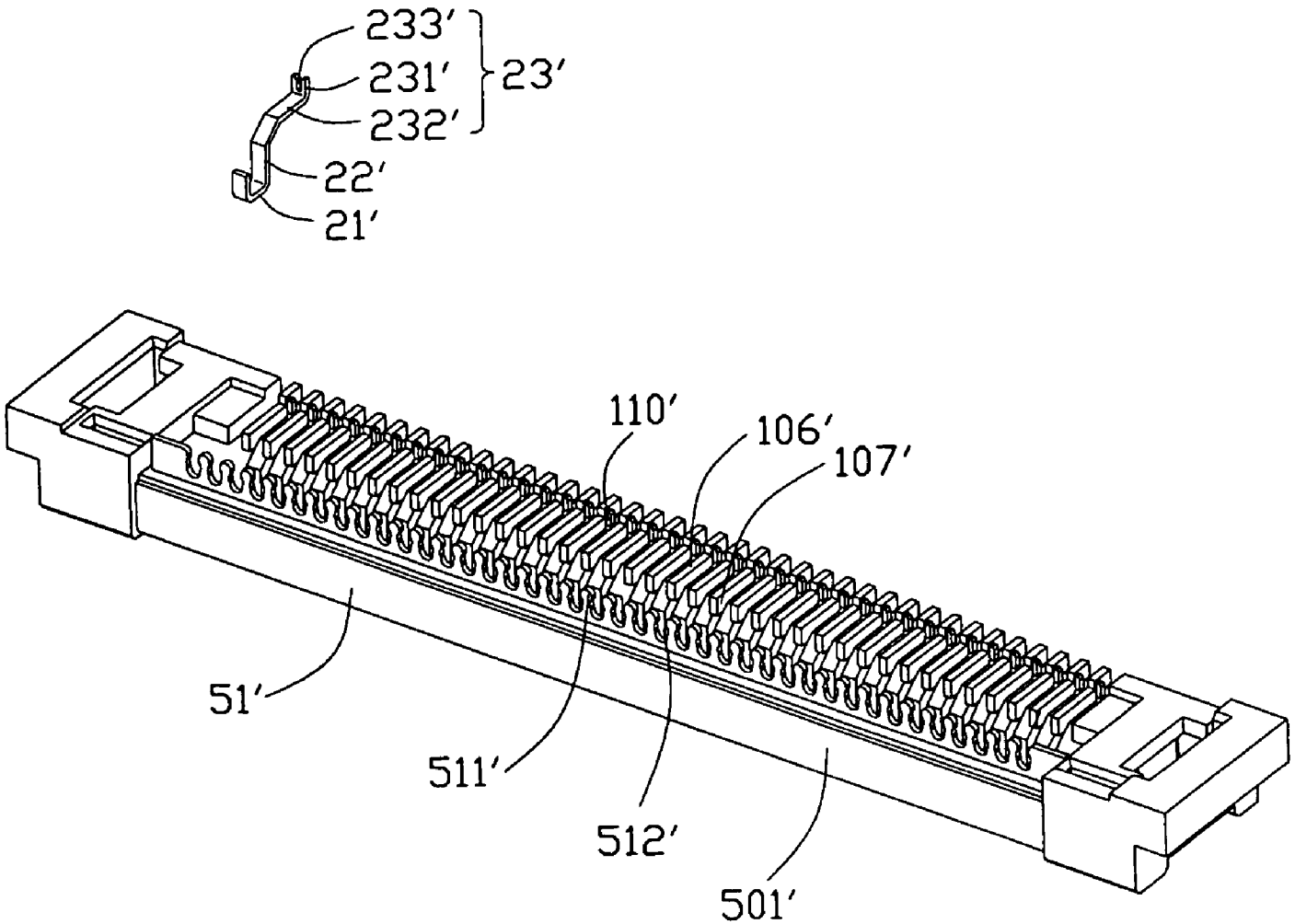
FIG. 14 is a partially assembled, perspective view of FIG. 12.
Figure 15:
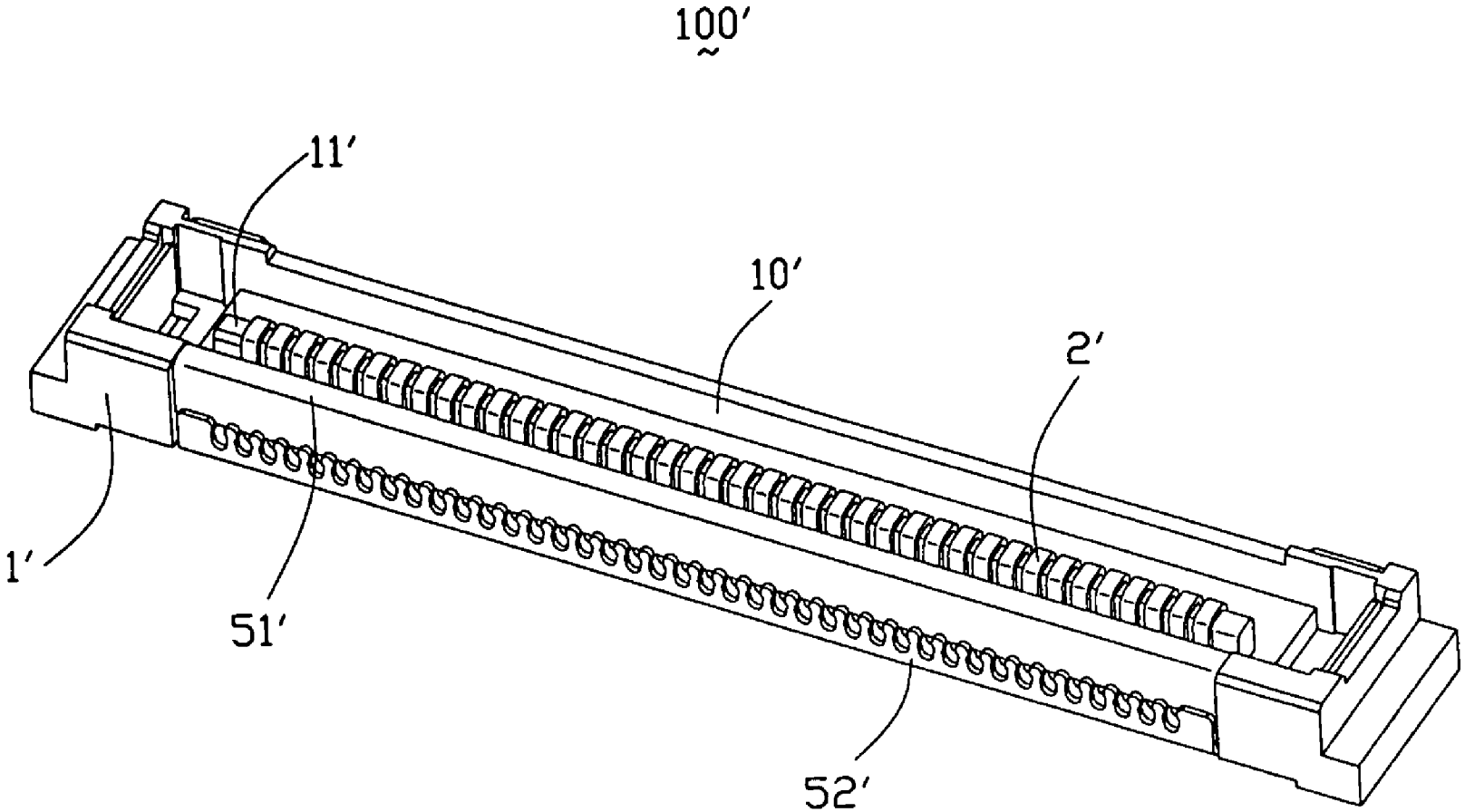
FIG. 15 is an assembled, perspective view of the micro coaxial cable connector assembly of the second embodiment.

Referring to FIGS. 1-3, a micro coaxial electrical connector assembly 100 in accordance with the first embodiment of the present invention comprises an insulated housing 1, a plurality of contacts 2 arranged in a row along a transversal direction and received in the insulated housing 1, a number of coaxial wires 4 electrically connecting to the contacts 2, a wire spacer 3 used for positioning the coaxial wires 4 and a metal shell 5 shielding the insulated housing 1.

The insulated housing 1 comprises a base portion 10 and a matching portion 11 extending forwardly from the base portion 10. The matching portion 11 is composed of a tongue portion 111 and a pair of guiding posts 112 integrally formed at lateral sides of the tongue portion 111 respectively. Each guiding post 112 forms with tapered forward end for facilitating the insertion of the micro coaxial connector assembly 100 to a complementary connector. The base portion 10 comprises a mounting portion 101, a pair of lateral walls 102 formed at opposite lateral sides of the mounting portion 101 respectively, a beam 103 interconnecting with the mounting portion 101. A receiving space 104 is defined between the mounting portion, the pair of the side walls 102 and the beam 103. Each side wall 102 is L-shape and defines a cavity 105 thereon. A plurality of L-shape clapboards 106 align in a row along the transverse direction. The clapboards 106 are disposed on the mounting portion 101 and connecting with the beam 103. Thus, a plurality of passages 104 are formed between adjacent the two neighboring clapboards 106.

Each contact 2 comprises a retention portion 22, a mating portion 21 horizontally extending forwardly from the retention portion 22 with a slantways-extending tip end, a connecting portion 23 composed of a relatively front soldering portion 232 firstly rearwardly and slantways extending from the retention portion 22 then horizontally extending rearwardly, and a rear portion 231 extending upright from the end of the soldering portion 232. The rear portion 231 defines a Y-shape cutout 233.

The wire spacer 3 has a profile same as the receiving space 104 defined in the base portion 10. A rectangular soldering window 34 is formed between a front wall 31, a rear wall 32 and a pair of side walls 33. The rear wall 32 defines a plurality of through holes 321 and a pair of positioning holes 331 respectively recessing downwardly from the top surface of the rear wall 32 and arranged in a row along transversal direction. The dimension of the positioning hole 331 is larger than that of each through hole 321. A plurality of recesses 311 and grooves 322 respectively recess upwardly from the bottom surfaces of the front wall 31 and rear wall 32. The recesses 311 and grooves 322 are arranged in a row along the transversal direction. Each recess 311 aligns with corresponding groove 322 along the mating direction. A plurality of dividing blocks 323 separate adjacent grooves 322. Each dividing block 323 is divided into two parts by corresponding through holes 321.

Each coaxial wire 4 is composed of a conductor 44, an inner dielectric layer 43 surrounding the conductor 44, a braiding layer 42 covering the inner dielectric layer 43 and an outer jacket 41. Each front end of the coaxial wire 4 is stripped to expose the conductor 44, the inner dielectric layer 43 in turn. Part of the outer jacket 41 in a determined distance from the front end of each coaxial wire 4 is stripped to expose the braiding layer 42.

The metal shell 5 is made up of a first shield member 51 with a first body portion 501 and a second shield member 62 with a second body portion 502. A first end wall 510 extends downwardly from the rear edge of the first body portion 501 and a second end wall 520 extend upwardly from the rear edge of the second body portion 502, respectively. The first end wall 510 defines a plurality of first Ω-shape alike slots 512 with smooth inward surface and the second end wall 520 defines a plurality of second Ω-shape alike slots 522 with smooth inward surface, respectively. The first Ω-shape slots 512 communicate with distal edge of the first end wall 510 and the second invertion Ω-shape slots 522 communicate with distal edge of the second end wall 520. Every of two neighborhood first slots 512 and second slots 522 are respectively separated by a first dividing member 511 and a second dividing member 521. A pair of positioning posts 525 form on two sides of the second end wall 520 aligning in a row with the second dividing member 521. A pair of first ear parts 513 respectively extends downwardly from lateral sides of the first body portion 501. A pair of second ear parts 523 and another pair of third ear parts 524 respectively extend upwardly from lateral sides of the second body portion 502.

Referring to FIGS. 4-11 in conjunction with FIGS. 1-3, when assembling, the contacts 2 and the second shield member 52 are respectively insert molded together with the insulated housing 1. Each contact 2 with the mating portion 21 is partially embedded in the tongue portion 111 of the matching portion 11 and the retention portion 22 is retained in the beam 103. Each contact 2 with the connecting portion 23 and the rear portion 231 are disposed in the corresponding passage 107 to form soldering area 108 therein. The second shield member 52 with the body portion 502 shields housing 1 and the second ear parts 523 and the third ear parts 524 are embedded in the insulated housing 1. The second dividing members 521 and the positioning posts 525 extend upwardly and are received in the receiving space 104. Secondly, the coaxial wires 4 each are respectively pushed toward the wire spacer 3. End of each conductor is disposed in the corresponding recess 311 and the wires 4 are respectively received in corresponding groove 322. Each wire 4 is held by two dividing blocks 323 with the braiding layer 42 adjacent two through holes 321. The conductor 44 lies on the top of the window 34 to make soldering easily. Thirdly, the wire spacer 3 with the wires 4 is assembled to the receiving space 104 of the base portion 10 with the positioning posts 525 of the second shield member 52 interferentially received in the positioning holes 331 of the sidewalls 33. The second dividing members 521 upwardly extends into the through holes 321 with the braiding layers 42 received in the second slots 522 and electrically contacting with the second dividing members 521, respectively. Thus, a grounding path is formed between the coaxial wires 4 and the second shield member 52 to ensure the signal transmission performing well. Each conductor 4 is held by the cutout 233 of the contact 2 and placed in soldering area 108, respectively. The soldering area 108 exposes into the window 34 of the spacer 3 for soldering easily and facility. Lastly, the first shield member 51 of the metal shell 5 is assembled to the insulated housing 1 with the pair of the first ear parts 513 interferentially received in the cavities 105 of the side walls 102 respectively. The first body portion 501 shields the housing 1 and the first slots 512 holds the outer jacket 41 of the coaxial wires 4 together with the second slots 522 of the second shield member 52.

Referring to FIGS. 12-15, a micro coaxial cable connector assembly 100' in accordance with the second embodiment of the present invention is illustrated. In comparison with the first embodiment of the present invention, the second embodiment of the present invention is a vertical-type electrical connector assembly comprising an insulated housing 1', a plurality of contacts 2' arranged in a row along a transversal direction and received in the insulated housing 1', a plurality of coaxial wires (not shown) the same as the coaxial wires 4 of the first embodiment and electrically connecting to the contacts 2', and a metal shell 5' shielding the insulated housing 1'.

The insulated housing 1' comprises a base portion 10' and a matching portion 11' extending upwardly from the base portion 10'. The base portion 10' comprises a front wall 101', a back wall 102', a pair of lateral walls 103' and a bottom wall 104' interconnecting the front wall 101', the back wall 102' and the pair of lateral walls 103', thus circumscribing a receiving space 108 which is adapted for receiving the mating portion of the complementary connector. The matching portion 11' is an elongated body extending upwardly from a substantially middle part of an upper surface of the bottom wall 104' and protrudes into the receiving space 108. A plurality of L-shape clapboards 106' align in a row along the transverse direction. The clapboards 106' are disposed on a bottom surface of the bottom wall 104'. Thus, a plurality of passages 107' are formed between adjacent two neighboring clapboards 106'. A pair of cavities 109' respectively recess downwardly from the bottom surface of the back wall 102' and extending upwardly into the receiving space 108'. Also, a pair of through holes 105' are respectively defined in the bottom wall 104' and adjacent to the lateral walls 103' communicating with the receiving space 108'.

Each contact 2' comprises a retention portion 22', an L-shape mating portion 21' firstly extending forwardly from the bottom tip of the retention portion 22' then vertically extending upwardly, a connecting portion 23' composed of a relatively front soldering portion 232' firstly horizontally extending rearwardly from the top tip of the retention portion 22', and a rear portion 231' extending upright from the end of the soldering portion 232'. The rear portion 231' defines a Y-shape cutout 233'.

The metal shell 5' is also made up of a first substantially U-shape shield member 51' and a second substantially U-shape shield member 52'. The first U-shape shield member 51' comprises an L-shape first body portion 501' and a first end wall 510' extending downwardly from the front edge of the first body portion 501'. The second U-shape shield member 52' comprises an L-shape second body portion 502' and a second end wall 520' extending upwardly from the rear edge of the second body portion 502'. The second body portion 502' forms a pair of first ear parts 523' and another pair of second ear parts 524' respectively extending upwardly from lateral and rear sides thereon. The first end wall 510' defines a plurality of first Ω-shape slots 512' with smooth inward surface and the second end wall 520' defines a plurality of second Ω-shape slots 522' with smooth inward surface, respectively. The first Ω-shape slots 512' communicate with distal edge of the first end wall 510' and the second invertion Ω-shape slots 522' communicate with distal edge of the second end wall 520'. Every of two neighborhood first slots 512' and second slots 522' are respectively separated by a first dividing member 511' and a second dividing member 521'.

Referring to FIGS. 12-15 in conjunction with FIGS. 1-11, when assembling, the contacts 2' and the first shield member 51' are respectively insert molded together with the insulated housing 1' as described in the first embodiment, except that the retention portion 22' of each contact 2' is retained in the bottom wall 104' and the first shield member 51' with its body portion 501' shielding the back wall 102' and the first end wall 510' embedded in the bottom wall 104'. Secondly, each coaxial wires (not shown, the same as the coaxial wires 4 of the first embodiment) with the conductor is held by the cutout 233' of the contact 2' and placed in the soldering area 110', respectively; and each wire with braiding layer is received in the corresponding first slot 512'. Thus, the conductors of the wires can be soldered in the soldering area 110' stably, and a grounding path is formed between the coaxial wires 4 and the first shield member 51' to ensure the signal transmission performing well. Lastly, the second shield member 52' of the metal shell 5' is assembled to the insulated housing 1' with the pair of first ear parts 523' and the pair of second ear parts 524' are respectively interferentially received in the cavities 105' and through holes 109 to enhance the connection between the insulated housing 1' and the second shield member 52'. The coaxial wires can be held by the second slots 522' and positioned therein stably.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. A micro coaxial cable connector assembly, comprising:

an insulated housing defining a base portion with a plurality of passages thereon, a matching portion extending outwardly from the base portion;

a plurality of contacts received in the insulated housing with mating portions positioned in the matching portion and connecting portions together with rear portions disposed in the corresponding passage to form a soldering area, said the rear portion of each contact defining a cutout;

a plurality of wires each with a conductor within and a conductive braiding layer insulated from the conductor, wherein the conductor is held by the cutout on the rear portion of the corresponding contact; and a metal shell with an end wall defining a plurality slots which electrically engage with the braiding layer of each of the plurality of corresponding wires through physical contact.

2. The micro coaxial cable connector assembly as claimed in claim 1, wherein the contacts are insert molded with the insulated housing.

3. The micro coaxial cable connector assembly as claimed in claim 1, wherein the matching portion extends forwardly from the base portion.

4. The micro coaxial cable connector assembly as claimed in claim 3, wherein each contact comprises the mating portion horizontally extending forwardly from a retention portion, the connecting portion composed of a relatively front soldering portion firstly rearwardly and slantways extending from the retention portion then horizontally extending rearwardly, and the rear portion extending upright from the end of the soldering portion.

5. The micro coaxial cable connector assembly as claimed in claim 3, wherein the metal shell includes a first shield member and a second shield member, and wherein the first shield member is assembled to the insulated housing and the second shield member is insert molded with the insulated housing.

6. The micro coaxial cable connector assembly as claimed in claim 5, wherein the first shield member and the second shield member respectively comprises a first body portion and a second body portion which covers the insulated housing.

7. The micro coaxial cable connector assembly as claimed in claim 5, wherein the second shield member forms at least one pair of ear parts which are embedded in the insulated housing.

8. The micro coaxial cable connector assembly as claimed in claim 5, wherein the first shield member forms a pair of parts, wherein the insulated housing comprises a pair of lateral walls each defining a cavity for receiving the corresponding ear parts.

9. The micro coaxial cable connector assembly as claimed in claim 5, further comprising a wire spacer with a soldering window.

10. The micro coaxial cable connector assembly as claimed in claim 9, wherein the wire spacer defines a row of recesses arranged along a transverse direction and each recess receiving an end of the corresponding conductor.

11. The micro coaxial cable connector assembly as claimed in claim 10, wherein the wire spacer defines a plurality of grooves respectively aligning with the recesses; wherein individual grooves position individual wires.

12. The micro coaxial cable connector assembly as claimed in claim 11, wherein the conductors are exposed in the soldering window for soldering easily.

13. The micro coaxial cable connector assembly as claimed in claim 11, wherein the wire spacer defines a plurality of dividing blocks each separating every two neighboring grooves.

14. The micro coaxial cable connector assembly as claimed in claim 13, wherein the wire spacer comprises a rear wall which defines a plurality of through holes each separating a corresponding wall which defines a plurality of through holes each separating a corresponding dividing block into two parts.

15. The micro coaxial cable connector assembly as claimed in claim 14, wherein the housing defines a receiving space wherein the shield member has a plurality of dividing members which are received by the corresponding through holes of the wire spacer.

16. The micro coaxial cable connector assembly as claimed in claim 1, wherein the matching portion of the insulated housing extends upwardly from the base portion.

17. The micro coaxial cable connector assembly as claimed in claim 16, wherein at least one of the contacts comprises a mating portion, a retention portion, a connecting portion, a soldering portion and a rear portion all of which embody an overall L-shape, wherein the mating portion lies perpendicular to the rear portion and extends forwardly from the retention portion, wherein the retention portion extends forwardly from the connecting portion, and wherein the mating, retention, connecting and soldering portions extend forwardly from and perpendicular to the rear portion.

18. The micro coaxial cable connector assembly as claimed in claim 16, wherein the metal shell includes a first shield member and a second shield member, and wherein the first shield member is insert molded with the insulated housing and the second shield member is assembled to the insulated housing.

19. The micro coaxial cable connector assembly as claimed in claim 18, wherein the second shield member forms a pair of ear parts, and wherein the insulated housing defines a pair of lateral walls each defining a cavity for receiving the ear parts.

20. A micro coaxial cable connector assembly, comprising:

an insulated housing defines a plurality of grooves therein;

a plurality of contacts received in the corresponding grooves, respectively;

a plurality of wires each comprising inner and outer conductors insulated from one another, wherein the inner conductor of each wire is electrically and mechanically connected to a corresponding contact, and a metal shell with an end wall which is defined by a plurality of slots that align with the corresponding grooves of the insulated housing; wherein each slot of the metal shell electrically engages the outer conductor of each corresponding wire through physical contact.

* * * * *